US006235695B1

(12) United States Patent
Blum et al.

(10) Patent No.: US 6,235,695 B1
(45) **Date of Patent: *May 22, 2001**

(54) CLEANING AGENT WITH OLIGOAMMINE ACTIVATOR COMPLEXES FOR PEROXIDE COMPOUNDS

(75) Inventors: Helmut Blum, Duesseldorf; Peter Jeschke, Neuss; Juergen Haerer, Duesseldorf; Siglinde Erpenbach, Meerbusch; Christian Nitsch, Duesseldorf, all of (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/155,767

(22) PCT Filed: Mar. 24, 1997

(86) PCT No.: PCT/EP97/01480

§ 371 Date: Oct. 1, 1998

§ 102(e) Date: Oct. 1, 1998

(87) PCT Pub. No.: WO97/36986

PCT Pub. Date: Oct. 9, 1997

(30) Foreign Application Priority Data

Apr. 1, 1996 (DE) ..... 196 13 104
Nov. 27, 1996 (DE) ..... 196 49 103

(51) Int. Cl.[7] ..... C11D 3/26; C11D 3/39; C11D 3/395

(52) U.S. Cl. ..... 510/220; 510/221; 510/224; 510/372; 510/376; 510/378; 134/25.2; 252/186.26; 252/186.28; 252/186.33

(58) Field of Search ..... 510/220, 221, 510/224, 372, 376, 378; 134/25.2; 252/186.26, 186.28, 186.33

(56) References Cited

U.S. PATENT DOCUMENTS

| | | | |
|---|---|---|---|
| 4,585,642 | 4/1986 | Rieck | 423/333 |
| 4,664,839 | 5/1987 | Rieck | 252/175 |
| 4,820,839 | 4/1989 | Rieck | 252/135 |
| 5,183,651 | 2/1993 | Schimmel et al. | 423/334 |
| 5,229,095 | 7/1993 | Schimmel et al. | 423/334 |
| 5,236,682 | 8/1993 | Schimmel et al. | 423/334 |
| 5,268,156 | 12/1993 | Schimmel et al. | 423/334 |
| 5,308,596 | 5/1994 | Kotzian et al. | 423/333 |
| 5,318,733 | 6/1994 | Carduck et al. | 264/15 |
| 5,356,607 | 10/1994 | Just | 423/334 |
| 5,358,655 | 10/1994 | Kruse et al. | 252/95 |
| 5,382,377 | 1/1995 | Raehse et al. | 252/174 |
| 5,417,951 | 5/1995 | Just | 423/334 |
| 5,494,488 | 2/1996 | Arroldi et al. | 8/137 |
| 5,541,316 | 7/1996 | Engelskirchen et al. | 510/471 |
| 5,580,941 | 12/1996 | Krause et al. | 527/300 |
| 5,703,030 * | 12/1997 | Perkins et al. | 510/311 |
| 5,705,464 * | 1/1998 | Scheper et al. | 510/221 |
| 5,798,326 * | 8/1998 | Goldstein et al. | 510/221 |

FOREIGN PATENT DOCUMENTS

| | | |
|---|---|---|
| 94 58592 | 8/1994 | (AU) . |
| 1 036 455 | 8/1978 | (CA) . |
| 24 12 837 | 10/1974 | (DE) . |
| 26 09 221 | 9/1977 | (DE) . |
| 30 02 271 | 7/1981 | (DE) . |
| 42 21 381 | 2/1994 | (DE) . |
| 43 00 772 | 7/1994 | (DE) . |
| 43 03 320 | 8/1994 | (DE) . |
| 44 17 734 | 11/1995 | (DE) . |
| 44 16 438 * | 11/1995 | (DE) . |
| 44 43 177 * | 6/1996 | (DE) . |
| 196 05 688 | 2/1997 | (DE) . |
| 0 164 514 | 12/1985 | (EP) . |
| 0 164 552 | 12/1985 | (EP) . |
| 0 272 030 * | 6/1988 | (EP) . |
| 0 294 753 | 12/1988 | (EP) . |
| 0 392 592 * | 10/1990 | (EP) . |
| 0 425 427 | 5/1991 | (EP) . |
| 0 425 428 | 5/1991 | (EP) . |
| 0 436 835 | 7/1991 | (EP) . |
| 0 443 651 * | 8/1991 | (EP) . |
| 0 458 397 * | 11/1991 | (EP) . |
| 0 486 592 | 5/1992 | (EP) . |
| 0 502 325 | 9/1992 | (EP) . |
| 0 544 490 * | 6/1993 | (EP) . |
| 0 549 271 * | 6/1993 | (EP) . |
| 0 548 599 | 6/1993 | (EP) . |
| 0 579 659 | 1/1994 | (EP) . |
| 0 591 282 | 4/1994 | (EP) . |
| 0 630 964 * | 12/1994 | (EP) . |
| WO91/08171 | 6/1991 | (WO) . |
| WO92/11347 * | 7/1992 | (WO) . |
| WO93/16110 | 8/1993 | (WO) . |
| WO94/05762 * | 3/1994 | (WO) . |
| WO94/23005 * | 10/1994 | (WO) . |
| WO95/27775 | 10/1995 | (WO) . |
| WO95/33043 * | 12/1995 | (WO) . |

(List continued on next page.)

OTHER PUBLICATIONS

Derwent Patent Abstract (WPAT) 94–011551/02; Nov. 16, 1995.*

(List continued on next page.)

*Primary Examiner*—Gregory Delcotto
(74) *Attorney, Agent, or Firm*—Wayne C. Jaeschke; Glenn E.J. Murphy

(57) ABSTRACT

Complexes of the transition metals cobalt, iron, copper, and ruthenium having at least one and preferably at least five ammonia ligands are used to activate peroxygen compounds in aqueous cleaning solutions for hard surfaces. Compositions preferably contain 0.0025% to 0.25 by weight of the activating complex.

16 Claims, No Drawings

FOREIGN PATENT DOCUMENTS

| | | | |
|---|---|---|---|
| WO96/06155 | | 2/1996 | (WO) . |
| WO96/23861 | | 8/1996 | (WO) . |
| WO96/23859 | * | 8/1996 | (WO) . |
| WO97/00312 | | 1/1997 | (WO) . |
| WO97/00311 | * | 1/1997 | (WO) . |

OTHER PUBLICATIONS

Derwent Patent Abstract (WPAT) 94–075443/10; Mar. 17, 1994.*
Derwent Patent Abstract (WPAT) 96–287166/29; Jun. 13, 1996.*
Derwent Patent Abstract (WPAT) 92–218091/27; Jul. 9, 1992.*
Derwent Patent Abstract (WPAT) 94–311135/39; Oct. 13, 1994.*
Derwent Patent Abstract (WPAT) 80–58848C/34 Jul. 1981.
Derwent Patent Abstract (WPAT) 96–011551/02 Nov. 1995.
Derwent Patent Abstract (WPAT) 93–259656/33 Aug. 1993.
Derwent Patent Abstract (WPAT) 94–035002/04 Feb. 1994.
Derwent Patent Abstract (WPAT) 94–235530/29 Jul. 1994.
Derwent Patent Abstract (WPAT) 94–280420/35 Aug. 1994.
Derwent Patent Abstract (WPAT) 96–000404/01 Nov. 1995.
Derwent Patent Abstract (WPAT) 74–75753V/44 Oct. 1979.
Derwent Patent Abstract (WPAT) 91–126877/18 May 1991.
Derwent Patent Abstract (WPAT) 85–270605/44 Dec. 1985.
Derwent Patent Abstract (WPAT) 91–172613/24 Jun. 1991.
Derwent Patent Abstract (WPAT) 92–335303/41 Aug. 1992.
Derwent Patent Abstract (WPAT) 92–360500/44 Feb. 1991.
Derwent Patent Abstract (WPAT) 93–206465/26 Jun. 1993.
Derwent Patent Abstract (WPAT) 92–301673/37 Sep. 1992.
Derwent Patent Abstract (WPAT) 91–126878/18 May 1991.
Derwent Patent Abstract (WPAT) 91–209554/29 Jul. 1991.
Derwent Patent Abstract (WPAT) 85–290431/47 Dec. 1985.
Derwent Patent Abstract (WPAT) 88–355215/50 Dec. 1988.
Derwent Patent Abstract (WPAT) 92–218091 Jul. 1992.
Derwent Patent Abstract (WPAT) 91–073523/10 May 1992.
Derwent Patent Abstract (WPAT) 92–350618/43 Jan. 1994.
Derwent Patent Abstract (WPAT) 93/009585/02 Ap. 1994.
Derwent Patent Abstract (WPAT) 97–416938/39 Aug. 1997.
Derwent Patent Abstract (WPAT) 77–40004Y/23 Sep. 1977.
Chemical Abstracts 117:236692n Aug. 1992.
Chemical Abstracts 118:8928j Sep. 1992.

* cited by examiner

CLEANING AGENT WITH OLIGOAMMINE ACTIVATOR COMPLEXES FOR PEROXIDE COMPOUNDS

This invention relates to the use of certain oligoammine complexes of transition metals as activators or catalysts for peroxygen compounds, more particularly inorganic peroxygen compounds, for bleaching colored stains on hard surfaces and to cleaning formulations for hard surfaces containing such activators or catalysts.

Inorganic peroxygen compounds, more particularly hydrogen peroxide, and solid peroxygen compounds which dissolve in water with elimination of hydrogen peroxide, such as sodium perborate and sodium carbonate perhydrate, have long been used as oxidizing agents for disinfecting and bleaching purposes. In dilute solutions, the oxidizing effect of these substances depends to a large extent on the temperature. For example, with $H_2O_2$ or perborate in alkaline bleaching liquors, sufficiently rapid bleaching of soiled textiles is only achieved at temperatures above about 80° C. At lower temperatures, the oxidizing effect of the inorganic peroxygen compounds can be improved by addition of so-called bleach activators for which numerous proposals, above all from the classes of N- or O-acyl compounds, for example polyacylated alkylenediamines, more particularly tetraacetyl ethylenediamine, acylated glycolurils, more particularly tetraacetyl glycoluril, N-acylated hydantoins, hydrazides, triazoles, hydrotriazines, urazoles, diketopiperazines, sulfuryl amides and cyanurates, also carboxylic anhydrides, more particularly phthalic anhydride, carboxylic acid esters, more particularly sodium nonanoyloxybenzenesulfonate, sodium isononanoyloxybenzenesulfonate and acylated sugar derivatives, such as pentaacetyl glucose, can be found in the literature. By adding these substances, the bleaching effect of aqueous peroxide liquors can be increased to such an extent that substantially the same effects are obtained at temperatures of only 60° C. as are obtained with the peroxide liquor alone at 95° C.

In the search for energy-saving washing and bleaching processes, operating temperatures well below 60° C. and, more particularly, below 45° C. down to the temperature of cold water have acquired increasing significance in recent years.

At these low temperatures, there is generally a discernible reduction in the effect of known activator compounds. Accordingly, there has been no shortage of attempts to develop more effective activators for this temperature range although the results achieved thus far have not been convincing. A starting point in this connection is the use of the transition metal salts and complexes proposed, for example, in European patent applications EP 392 592, EP 443 651, EP 458 397, EP 544 490 or EP 549 271 as so-called bleach catalysts. In their case, the high reactivity of the oxidizing intermediates formed from them and the peroxygen compound is presumably responsible for the risk of discoloration of colored textiles and, in extreme cases, oxidative textile damage. In European patent application EP 272 030, cobalt (III) complexes with ammonia ligands which may additionally contain other mono-, bi-, tri- and/or tetradentate ligands are described as activators for $H_2O_2$. European patent application EP 630 964 describes certain manganese complexes which do not have a pronounced effect in boosting the bleaching action of peroxygen compounds and which do not decolor dyed textile fibers although they are capable of bleaching soil or dye detached from fibers in wash liquors. German patent application DE 44 16 438 describes manganese, copper and cobalt complexes which can carry ligands from a number of groups of compounds and which are said to be used as bleaching and oxidation catalysts.

The problem addressed by the present invention was to improve the oxidizing and bleaching effect of inorganic peroxygen compounds at low temperatures below 80° C. and, more particularly, in the range from about 15° C. to 45° C.

It has now been found that certain transition metal complexes containing at least one ammonia molecule as ligand have a distinct bleach-catalyzing effect on colored stains on hard surfaces.

The present invention relates to the use of complex compounds corresponding to general formula I:

$$[Mn(NH_3)_{6-x}(L)_x]A_n \qquad (I)$$

where M is a transition metal selected from cobalt, iron, copper and ruthenium, L is a ligand selected from the group consisting of water, hydroxide, chlorate, perchlorate, $(NO_2)^-$, carbonate, nitrate, acetate and thiocyanate, x is a number of 0 to 5, A is a salt-forming anion and n—which may even be 0—is a number with such a value that the compound of formula (I) has no charge, as activators for peroxygen compounds, particularly inorganic peroxygen compounds, in aqueous cleaning solutions for hard surfaces, more particularly for crockery.

In the present case, an $(NO_2)^-$ group is a nitro ligand which is attached to the transition metal by the nitrogen atom or a nitrito ligand which is attached to the transition metal by an oxygen atom. The $(NO_2)^-$ group may also be attached to a transition metal M to form a chelate

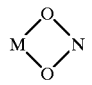

It may also bridge two transition metal atoms asymmetrically:

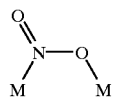

or $\eta^1$-O:

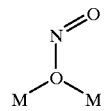

The above-mentioned transition metals in the bleach catalysts to be used in accordance with the invention are preferably present with oxidation numbers of +2, +3 or +4. Complexes with transition metal central atoms having the oxidation number +3 are preferably used. Preferred complexes include those with cobalt as central atom.

Besides the ammonia ligands, of which at least 1 and preferably at least 5 are present per transition metal central atom, the transition metal complexes to be used in accordance with the invention may contain other inorganic ligands of generally simple structure (L in formula I), more particularly mono- or polyvalent anionic ligands, providing at least one ammonia molecule is present as ligand in the complex. Examples of such other ligands are nitrate, acetate, thiocyanate, chlorate and perchlorate and the halides, such as chloride, bromide, iodide and fluoride. The anionic ligands are intended to provide for charge equalization between the transition metal central atom and the ligand system. Oxo ligands, hydroxo ligands, amido ligands, imido ligands, peroxo ligands and imino ligands may also be present in addition to or instead of the ligands L. These ligands may also have a bridging effect so that polynuclear complexes are formed. These complexes contain at least 1 and preferably at least 4 ammonia ligand(s) and preferably at least 1 $(NO_2)^-$ group per transition metal atom. In the case of bridged binuclear complexes, the two metal atoms in the complex do not have to be the same. Binuclear complexes in which the two transition metal central atoms have different oxidation numbers may be used.

In the absence of anionic ligands or if the presence of anionic ligands does not lead to charge equalization in the complex, the compounds to be used in accordance with the invention contain anionic counterions (A in formula I) which neutralize the cationic complex. These anionic counterions include in particular nitrate, hydroxide, hexafluorophosphate, sulfate, chlorate, perchlorate, halides, such as chloride, fluoride, iodide and bromide, or the anions of carboxylic acids, such as formate, acetate, benzoate or citrate. These anionic counterions are present in the compounds of formula I in such a number (n in formula I) that—in terms of size—the sum of the product of their number with their charge and the product of the number of anionic ligands (L in formula I) with their charge is exactly as large, but with a negative sign, as the charge of the transition metal central atom (M in formula I).

In cases where L is a bidentate ligand, for example the carbonato ligand, as mentioned above, optionally the $(NO_2)^-$ ligand or the nitrato ligand, which occupies two bond sites of the transition metal central atom in a mononuclear complex compound, formula (I) can only analogously reproduce the structure of the complex. Complex compounds such as these are more clearly represented by general formula (II):

$$[M(NH_3)_{6-x-2y}L_x(L^2)_y]A_n \quad \text{(II)}$$

where M, A, n and x are as defined above, L is a ligand attached via a coordination site and $L^2$ is the ligand attached via two coordination sites and y is a number of 0 to 2, with the proviso that x+2y is at most 5.

Preferred bleach catalysts according to the invention include hexammine cobalt(III) chloride, nitropentammine cobalt(III) chloride, nitritopentammine cobalt(III) chloride, nitratopentammine cobalt(III) chloride, chloropentammine cobalt(II) chloride, tetrammine carbonato-cobalt(III) chloride, tetrammine carbonato-cobalt(III) hydrogen carbonate and tetrammine carbonato-cobalt(III) nitrate and also $[NH_3)_5Co—O—O—Co(NH_3)_5Cl_4$.

A transition metal bleach catalyst such as this is preferably used in cleaning solutions for hard surfaces, more particularly for crockery, for bleaching colored stains. The term "bleaching" in this particular context applies both to the bleaching of soil, particularly tea, present on the hard surface and to the bleaching of soil suspended in the dishwashing liquor after detachment from the hard surface.

The present invention also relates to cleaning formulations for hard surfaces, more particularly dishwashing detergents and, among these, preferably machine dishwashing detergents containing a bleach catalyst corresponding to formula I and to a process for cleaning hard surfaces, more particularly crockery, using this bleach catalyst.

The use according to the invention essentially comprises creating conditions—in the presence of a hard surface soiled by colored stains—under which a peroxidic oxidizing agent and the bleach-catalyzing oligoammine complex can react with one another with a view to obtaining products with a stronger oxidizing effect. Such conditions prevail in particular when both reactants meet in an aqueous solution. This can be achieved by separately adding the peroxygen compound and the bleach-catalyzing oligoammine complex to a solution optionally containing a detergent. In one particularly advantageous embodiment, however, the process according to the invention is carried out using a detergent for hard surfaces according to the invention which contains the bleach-catalyzing oligoammine complex and optionally a peroxygen-containing oxidizing agent. The peroxygen compound may even be separately added to the solution as such or preferably in the form of an aqueous solution or suspension in cases where a peroxide-free formulation is used.

The conditions can be widely varied according to the application envisaged. Thus, besides purely aqueous solutions, mixtures of water and suitable organic solvents may serve as the reaction medium. The quantities of peroxygen compounds used are generally selected so that the solutions contain between 10 ppm and 10% of available oxygen and preferably between 50 and 5000 ppm of available oxygen. The quantity of bleach-catalyzing oligoammine complex used is also determined by the particular application envisaged. Depending on the required degree of activation, the activator is used in a quantity of 0.00001 mole to 0.025 mole and preferably in a quantity of 0.0001 mole to 0.002 mole per mole of peroxygen compound, although quantities above and below these limits may be used in special cases.

The present invention also relates to a cleaning formulation for hard surfaces, more particularly for crockery, which contains 0.001% by weight to 1% by weight and, more preferably, 0.005% by weight to 0.1% by weight of a bleach-catalyzing oligoammine complex corresponding to formula I in addition to typical ingredients compatible with the bleach catalyst. The bleach catalyst may be adsorbed onto supports and/or encapsulated in shell-forming substances by methods known in principle.

In addition to the bleach catalyst used in accordance with the invention, the cleaning formulations according to the invention, which may be present in the form of—in particular—powder-form or tablet-form solids, homogeneous solutions or suspensions, may in principle contain any known ingredients typically encountered in such formulations. In particular, the formulations according to the invention may contain builders, surfactants, peroxygen compounds, water-miscible organic solvents, enzymes, sequestering agents, electrolytes, pH regulators and other auxiliaries, such as silver corrosion inhibitors, foam regulators, additional peroxygen activators and dyes and perfumes.

A cleaning formulation for hard surfaces according to the invention may additionally contain abrasive constituents, more particularly from the group consisting of silica flours, wood flours, plastic flours, chalks, glass microbeads and mixtures thereof. Abrasives are present in the formulations according to the invention in quantities of preferably not more than 20% by weight and more preferably from 5% by weight to 15% by weight.

The present invention also relates to a machine dishwashing detergent containing—based on the detergent as a whole—15% by weight to 60% by weight and preferably 20% by weight to 50% by weight of a water-soluble builder component and 5% by weight to 25% by weight and preferably 8% by weight to 17% by weight of an oxygen-based bleaching agent, characterized in that it contains a bleach-catalyzing oligoammine complex, more particularly in quantities of 0.0025% by weight to 0.25% by weight, preferably 0.005% by weight to 0. 1% and most preferably 0.01% by weight to 0.1% by weight. A detergent such as this is in particular a low-alkalinity detergent, i.e. a detergent of which a 1% by weight solution has a pH value of 8 to 11.5 and preferably 9 to 10.5.

In principle, suitable water-soluble builder components, particularly in detergents of low alkalinity, are any of the builders typically used in machine dishwashing, for example alkali metal phosphates which may be present in the form of their alkaline, neutral or acidic sodium or potassium salts. Examples include trisodium phosphate, tetrasodium diphosphate, disodium dihydrogen phosphate, pentasodium triphosphate, so-called sodium hexametaphosphate, oligomeric trisodium phosphate with degrees of oligomerization of 5 to 1,000 and, more particularly, 5 to 50 and the corresponding potassium salts or mixtures of sodium and potassium salts. They may be used in quantities of up to about 55% by weight, based on the detergent as a whole. Other possible builder components are, for example, organic polymers of native or synthetic origin, above all polycarboxylates, which act as co-builders, particularly in hard-water areas. Suitable builder components of this type are, for example, polyacrylic acids and copolymers of maleic anhydride and acrylic acid and the sodium salts of these polymer acids. Commercially available products are, for example, Sokalan® CP5 and PA 30 (BASF). Polymers of native origin suitable as co-builders include, for example, oxidized starch, as known for example from International patent application WO 94/05762, and polyamino acids, such as polyglutamic acid or polyaspartic acid. Other possible builder components are naturally occurring hydroxycarboxylic acids, for example mono- and dihydroxysuccinic acid, α-hydroxypropionic acid and gluconic acid. Preferred builder components include the salts of citric acid, particularly sodium citrate. The sodium citrate used may be anhydrous trisodium citrate and—preferably—trisodium citrate dihydrate. The trisodium citrate dihydrate may be used in the form of a fine- or coarse-particle powder. The acids corresponding to the co-builder salts mentioned may also be present, depending on the pH value ultimately established in the formulations according to the invention.

Besides hydrogen peroxide, suitable oxygen-based bleaching agents are, above all, alkali metal perborate monohydrate and tetrahydrate and/or alkali metal percarbonate, sodium being the preferred alkali metal. Hydrogen peroxide can also be produced by an enzymatic system, i.e. by the use of a combination of an oxidase and its substrate. The use of sodium percarbonate has advantages, particularly in dishwashing detergents, because it has a particularly favorable effect on the corrosion behavior of glasses. Accordingly, the oxygen-based bleaching agent is preferably an alkali metal percarbonate, more particularly sodium percarbonate. Known peroxycarboxylic acids, for example dodecane diperacid, or phthalimidopercarboxylic acids, which may optionally be substituted at the aromatic group, may also be present in addition to or, more particularly, as an alternative to the above-mentioned bleaching agents. Moreover, the addition of small quantities of known bleach stabilizers, for example phosphonates, borates or metaborates and metasilicates and magnesium salts, such as magnesium sulfate, can also be useful.

Standard transition metal complexes known as bleach activators and/or conventional bleach activators, i.e. compounds which form optionally substituted perbenzoic acid and/or peroxocarboxylic acids containing 1 to 10 and more particularly 2 to 4 carbon atoms under perhydrolysis conditions, may be used in addition to the bleach-catalyzing oligoammine complexes described above. Suitable conventional bleach activators are the typical bleach activators mentioned at the beginning which contain O- and/or N-acyl groups with the number of carbon atoms mentioned and/or optionally substituted benzoyl groups. Preferred conventional bleach activators are polyacylated alkylenediamines, more particularly tetraacetyl ethylenediamine (TAED), acylated glycolurils, more particularly tetraacetyl glycoluril (TAGU), acylated triazine derivatives, more particularly 1,5-diacetyl-2,4-dioxohexahydro-1,3,5-triazine (DADHT), acylated phenyl sulfonates, more particularly nonanoyl or isononanoyloxybenzenesulfonate, acylated polyhydric alcohols, more particularly triacetin, ethylene glycol diacetate and 2,5-diacetoxy-2,5-dihydrofuran, and acetylated sorbitol and mannitol, acylated sugar derivatives, more particularly pentaacetyl glucose (PAG), pentaacetyl fructose, tetaacetyl xylose and octaacetyl lactose and acetylated, optionally N-alkylated glucamine and gluconolactone. The combinations of conventional bleach activators known from German patent application DE 44 43 177 may also be used. In one preferred embodiment of formulations according to the invention, 0.5% by weight to 5% by weight of compounds which eliminate peroxocarboxylic acids under perhydrolysis conditions are present in addition to the complex compounds.

The machine dishwashing detergents according to the invention are preferably of low alkalinity and contain the usual alkali carriers such as, for example, alkali metal silicates, alkali metal carbonates and/or alkali metal hydrogen carbonates. The alkali carriers normally used include carbonates, hydrogen carbonates and alkali metal silicates with a molar $SiO_2/M_2O$ ratio (M=alkali metal atom) of 1.5:1 to 2.5:1. Alkali metal silicates may be present in quantities of up to 30% by weight, based on the detergent as a whole. Highly alkaline metasilicates are preferably not used at all as alkali carriers. The alkali carrier system preferably used in the detergents according to the invention is a mixture of carbonate and hydrogen carbonate, preferably sodium carbonate and hydrogen carbonate, which is present in a quantity of up to 60% by weight and preferably 10% by weight to 40% by weight. The ratio of carbonate used to hydrogen carbonate used varies according to the pH value ultimately required although an excess of sodium hydrogen carbonate is normally used so that the ratio by weight of hydrogen carbonate to carbonate is generally 1:1 to 15:1.

Another embodiment of detergents according to the invention is characterized by the presence of 20% by weight to 40% by weight of water-soluble organic builders, more particularly alkali metal citrate, 5% by weight to 15% by weight of alkali metal carbonate and 20% by weight to 40% by weight of alkali metal disilicate.

Surfactants, particularly low-foaming nonionic surfactants, may be added to the detergents according to the invention to facilitate the detachment of greasy soils, to act as wetting agents and—optionally—to serve as granulation aids in the production of the detergents. They may be present in quantities of up to 10% by weight, preferably in quantities of up to 5% by weight and more preferably in quantities of 0.5% by weight to 3% by weight. Extremely low-foaming compounds are normally used, particularly in machine dishwashing detergents. Preferred compounds of this type include $C_{12-18}$ alkyl polyethylene glycol propylene glycol ethers containing up to 8 ethylene oxide units and up to 8 propylene oxide units in the molecule. However, other known low-foaming nonionic surfactants may also be used, including for example $C_{12-18}$ alkyl polyethylene glycol polybutylene glycol ethers containing up to 8 ethylene oxide units and up to 8 butylene oxide units in the molecule, endpped alkyl polyalkylene glycol mixed ethers and the foaming but ecologically attractive $C_{8-14}$ alkyl polyglucosides with a degree of polymerization of about 1 to 4 (for example APG® 225 and APG® of Henkel KGaA) and/or $C_{12-14}$ alkyl polyethylene glycols containing 3 to 8 ethylene oxide units in the molecule. Also suitable are surfactants from the family of glucamides, for example alkyl-N-methyl glucamides in which the alkyl moiety preferably emanates from a $C_{6-14}$ fatty alcohol. It is sometimes of advantage to use the described surfactants in the form of mixtures, for example a mixture of alkyl polyglycoside and fatty alcohol ethoxylates or glucamide with alkyl polyglycosides.

Although it is known that transition metal complexes can counteract the corrosion of silver, the bleach-catalyzing oligoammine complexes according to the invention are generally used in quantities which are too small to be able to protect silver against corrosion so that silver corrosion inhibitors may be additionally used in dishwashing detergents according to the invention. Preferred silver corrosion inhibitors are organic disulfides, dihydric phenols, trihydric phenols, cobalt, manganese, titanium, zirconium, hafnium, vanadium or cerium salts and/or complexes in which the metals mentioned may have one of the oxidation numbers II, III, IV, V or VI.

The detergents according to the invention may additionally enzymes, such as proteases, amylases, pullulanases, cutinases and lipases, for example proteases, such as BLAP®, Optimase®, Opticlean®, Maxacal®, Maxapem®, Esperase® and/or Savinase®; amylases, such as Termamyl®, Amylase-LT®, Maxamyl®, Duramyl® and/or Purafect® OxAm; lipases, such as Lipolase®, Lipomax®, Lumafast® and/or Lipozym®. As described for example in International patent applications WO 92/11347 or WO 94/23005, the enzymes optionally used may be adsorbed onto supports and/or encapsulated in shell-forming substances to protect them against premature inactivation. They are present in the detergents according to the invention in quantities of preferably not more than 2% by weight and, more preferably, between 0.1% by weight and 0.7% by weight.

If the detergents foam excessively in use, up to 6% by weight and preferably about 0.5% by weight to 4% by weight of a foam-suppressing compound, preferably from the group of silicone oils, mixtures of silicone oil and hydrophobicized silica, paraffins, paraffin/alcohol combinations, hydrophobicized silica, bis-fatty acid amides and other known commercially available foam inhibitors may be added to them. Other optional ingredients in the formulations according to the invention are, for example, perfume oils.

Organic solvents suitable for use in the formulations according to the invention, particularly where they are present in liquid or paste-like form, include alcohols containing 1 to 4 carbon atoms, more particularly methanol, ethanol, isopropanol and tert.butanol, diols containing 2 to 4 carbon atoms, more particularly ethylene glycol and propylene glycol, and mixtures thereof and the ethers derived from compounds belonging to the classes mentioned above. Water-miscible solvents such as these are present in the detergents according to the invention in quantities of preferably not more than 20% by weight and, more preferably, in quantities of 1% by weight to 15% by weight.

To establish a desired pH value which is not automatically adjusted by the mixture of the other components, the formulations according to the invention may contain system-compatible and ecologically compatible acids, more particularly citric acid, acetic acid, tartaric acid, malic acid, lactic acid, glycolic acid, succinic acid, glutaric acid and/or adipic acid, and mineral acids, more particularly sulfuric acid or alkali metal hydrogen sulfates, or bases, more particularly ammonium or alkali metal hydroxides. pH regulators such as these are present in the formulations according to the invention in quantities of preferably not more than 10% by weight and, more preferably, between 0.5% by weight and 6% by weight.

In one preferred embodiment, machine dishwashing detergents according to the invention contain 50% by weight to 60% by weight of sodium phosphate, 15% by weight to 25% by weight of sodium carbonate or a mixture thereof with polymeric polycarboxylate, 5% by weight to 15% by weight of sodium perborate or percarbonate, 0.5% by weight to 5% by weight of bleach activator eliminating peroxocarboxylic acid under perhydrolysis conditions, 0.5% by weight to 7.5% by weight of surfactant, 2% by weight to 10% by weight of sodium silicate and 0.1% by weight to 0.75% by weight of silver corrosion inhibitor, more particularly benzotriazole.

The production of solid formulations according to the invention does not involve any difficulties and may be carried out by methods known in principle, for example by spray drying or granulation, the peroxygen compound and bleach catalyst optionally being separately added later.

Detergents according to the invention in the form of aqueous solutions or solutions containing other typical solvents are produced with particular advantage simply by mixing the ingredients which may be introduced into an automatic mixer either as such or in the form of a solution.

The detergents according to the invention are preferably present as powders, granules or tablets which may be produced in known manner, for example by mixing, granulation, roll compacting and/or by spray drying of the heat-resistant components and adding the more sensitive components, including in particular enzymes, bleaching agents and the bleach catalyst.

Detergents according to the invention in tablet form are preferably produced by mixing all the ingredients in a mixer and tableting the resulting mixture in conventional tablet presses, for example eccentric presses and rotary presses, under pressures of $200 \cdot 10^5$ Pa to $1{,}500 \cdot 10^5$ Pa. Fracture-resistant tablets dissolving sufficiently quickly under in-use conditions with flexural strengths of normally >150 N are readily obtained in this way. A tablet thus produced has a weight of 15 to 40 g and preferably 20 g to 30 g for a diameter of 35 mm to 40 mm.

Detergents according to the invention in the form of dust-free, storable free-flowing powders or granules with high bulk densities of 800 to 1,000 g/l can be produced by first mixing the builder components with at least part of the liquid components to increase the bulk density of this so-called compound and then combining the other ingredients of the formulation, including the bleach catalyst, with the resulting compound, if desired after drying.

Machine dishwashing detergents according to the invention may be used both in domestic dishwashing machines and in institutional dishwashing machines. They are added by hand or by suitable dispensers. The in-use concentrations in the wash liquor are generally about 1 to 8 g/l and preferably 2 to 5 g/l.

A machine wash program is generally augmented and terminated by a few rinse cycles with clear water following the main wash cycle and a final rinse cycle with a conventional rinse aid. After drying, completely clean and hygienically satisfactory dishes are obtained using a detergent according to the invention.

EXAMPLES

A machine dishwashing detergent (C1) containing 45 parts by weight of sodium citrate, 5 parts by weight of sodium carbonate, 31 parts by weight of sodium hydrogen carbonate, 1 part by weight of protease granules and 1 part by weight of amylase granules, 2 parts by weight of nonionic surfactant and also 12 parts by weight of sodium percarbonate and 2 parts by weight of N,N,N',N'-tetraacetylethylenediamine (TAED), a detergent (C2) containing 10 parts by weight of sodium percarbonate and 4 parts by weight of TAED for otherwise the same composition as V1, a detergent according to the invention (M1) containing 0.025 part by weight of nitropentammine cobalt (III) chloride for otherwise the same composition as V1 and detergents according to the invention containing 0.017 part by weight of tetrammine carbonato-cobalt(III) hydrogen carbonate monohydrate (M2), 0.016 part by weight of tetrammine carbonato-cobalt(III) nitrate hemihydrate (M3), 0.022 part by weight of tetrammine carbonato-cobalt(III) chloride (M4) or 0.034 part by weight of pentammine nitrato-cobalt(III) perchlorate (M5) for otherwise the same composition as V2 were tested as described in the following:

To produce standardized tea films, teacups were immersed 25 times in a tea solution heated to 70° C. A little of the tea solution was then poured into each teacup after which the teacups were dried in a drying cabinet. 8 of the tea-stained teacups were then washed in a Bosch® G 575 dishwasher (20 g detergent, 55° C. program, water hardness 14° dH to 16° dH) after which film removal was visually scored on a scale of 0 (=unchanged very pronounced film) to 10 (=no film).

TABLE 3

Film Removal Scores

| Detergent | Score |
|---|---|
| M1 | 7 |
| M2 | 9 |
| M3 | 9–10 |
| M4 | 9 |
| M5 | 9 |
| C1 | 3 |
| C2 | 4 |

It can be seen that a far better bleaching effect can be obtained by the use according to the invention (M1 to M5) than by the conventional bleach activator TAED alone (C1 or C2). Substantially the same or even slightly better results were obtained when the sodium percarbonate in the detergents according to the invention was replaced by sodium perborate.

What is claimed is:

1. A method of cleaning a hard surface comprising the steps of activating a peroxygen compound with a complex of formula I:

$$[M_n(NH_3)_{6-x}(L)_x]A_n \quad (I)$$

wherein M is a transition metal selected from the group consisting of iron, copper, and ruthenium, L is a ligand selected from the group consisting of water, hydroxide, chlorate, perchlorate, $(NO_2)^-$, carbonate, nitrate, halide, and thiocyanate, x is a number of 0 to 5, A is a salt-forming anion, n is a number such that the complex of formula (I) has no charge, and contacting a hard surface with an effective amount of an aqueous cleaning solution comprising the activated peroxygen compound.

2. A method according to claim 1, wherein the peroxygen compound is inorganic.

3. A method of cleaning a hard surface comprising the steps of activating a peroxygen compound with a bridged binuclear complex of a transition metal selected from the group consisting of cobalt, iron, copper, and ruthenium, said complex containing at least 1 ammonia ligand per transition metal atom, and contacting a hard surface with an effective amount of an aqueous cleaning solution comprising the activated peroxygen compound, wherein the complex has a bridge ligand selected from the group consisting of oxo, hydroxo, peroxo, amido, imido, and imino.

4. A method according to claim 3, wherein the complex has at least 4 ammonia ligands per transition metal atom.

5. A method according to claim 1, wherein the transition metal is iron.

6. A method according to claim 3, wherein the transition metal is cobalt.

7. A method according to claim 1, wherein the transition metal has an oxidation number of +3.

8. A method according to claim 3, wherein the transition metal has an oxidation number of +3.

9. A method according to claim 1, wherein L is a halide or an $(NO_2)^-$ group.

10. A method according to claim 1, wherein A is selected from the group consisting of nitrate, hydroxide, hexafluorophosphate, sulfate, chlorate, perchlorate, halide, and an anion of a carboxylic acid.

11. A method according to claim 10, wherein the anion of a carboxylic acid is selected from the group consisting of formate, acetate, benzoate, and citrate.

12. A method according to claim 1, wherein the peroxygen compound is selected from the group consisting of organic per acids, hydrogen peroxide, perborate, percarbonate, and mixtures thereof.

13. A dishwashing detergent composition comprising 0.0025% to 0.25% by weight of a bleach catalyst comprising a complex of a transition metal selected from the group consisting of iron, copper, and ruthenium, said complex containing at least 1 ammonia ligand, 50% to 60% by weight of sodium phosphate, 15% to 25% by weight of sodium carbonate or a mixture thereof with polymeric polycarboxylate, 5% to 15% by weight of sodium perborate or percarbonate, 0.5% to 5% by weight of a bleach activator that eliminates peroxocarboxylic acid under perhydrolysis conditions, 0.5% to 7.5% by weight of a surfactant, 2% to 10% by weight of sodium silicate, and 0.1% to 0.75% by weight of a silver corrosion inhibitor.

14. A dishwashing detergent according to claim 13 comprising 0.01% to 0.1% by weight of the bleach catalyst.

15. A dishwashing detergent according to claim 13 wherein the complex contains at least 5 ammonia ligands.

16. A detergent according to claim 13, wherein the silver corrosion inhibitor is benzotriazole.

* * * * *